US005709314A

United States Patent [19]

Petry

[11] Patent Number: 5,709,314

[45] Date of Patent: Jan. 20, 1998

[54] STACKABLE CONTAINER WITH AN EASY CLEAN SEAL

[76] Inventor: Robert W. Petry, 4390 N. Riverside Dr., Columbus, Ind. 47203

[21] Appl. No.: 609,773

[22] Filed: Mar. 1, 1996

[51] Int. Cl.[6] ..... B65D 43/04

[52] U.S. Cl. ..... 220/802; 206/508

[58] Field of Search ..... 220/355, 796, 220/797, 802, 780, 789, 792; 206/508

[56] References Cited

U.S. PATENT DOCUMENTS

| | | | |
|---|---|---|---|
| 751,318 | 2/1904 | Maranville | 220/355 |
| 858,902 | 7/1907 | Norton | 220/802 |
| 1,833,752 | 11/1931 | Longchamp | 206/508 |
| 2,818,997 | 1/1958 | Henchert | 222/143 |
| 2,833,452 | 5/1958 | Drummond et al. | 222/555 |
| 2,998,158 | 8/1961 | Tupper | 220/355 |
| 3,001,564 | 9/1961 | Hopkins | 206/508 |
| 3,355,056 | 11/1967 | Fisch | 220/355 |
| 3,732,909 | 5/1973 | Rooke et al. | 220/355 |
| 3,782,602 | 1/1974 | Page | 222/143 |
| 3,880,288 | 4/1975 | Hunter | 206/508 |
| 3,913,785 | 10/1975 | Pattershall | 220/354 |
| 4,378,895 | 4/1983 | Woinarski . | |
| 4,718,571 | 1/1988 | Bordner | 220/270 |
| 4,759,478 | 7/1988 | Richardson et al. | 222/556 |
| 5,150,804 | 9/1992 | Blanchet et al. | 220/212 |

*Primary Examiner*—Stephen J. Castellano
*Attorney, Agent, or Firm*—Woodard, Emhardt, Naughton, Moriarty & McNett

[57] ABSTRACT

A container for storing liquid is contemplated which comprises a rigid vessel defining a chamber to retain liquid, the vessel has a generally vertical sidewall and an outer top surface. The outer top surface defines a mouth intersecting the chamber which is configured to move liquid to and from the chamber. The top surface defines a circumferential ledge having an outer edge connected to the sidewall. The top surface also defines an upturned lip connected to the ledge and circumscribing the mouth with the lip being horizontally inset from the outer edge by the ledge. A lid is removably connected to the vessel by press-on attachment with the lid having an upper surface opposing a lower surface. The lid includes a circumferential outer flange seated on the ledge and a stacking rib projecting upward from the upper surface with the rib being circumscribed by the flange as well as circumscribing a central portion of the lid. A sealing channel is defined by the lower surface and positioned within the rib with a lip interlockingly engaging the channel to seal the lid over the mouth. The outer top surface is grooveless and is configured without a cavity capable of accumulating or retaining liquid.

16 Claims, 4 Drawing Sheets

STACKABLE CONTAINER WITH AN EASY CLEAN SEAL

BACKGROUND OF THE INVENTION

The present invention relates to containers, and more particularly to stackable containers which have a resealable press-on lid.

One type of container has a press-on lid which engages a sealing groove in the top side of a liquid retaining vessel to provide closure. Unfortunately, this sealing groove can become clogged with debris or materials being moved to and from the container. Such clogging may compromise seal integrity. For container vessels holding adhesive liquids such as paint, varnish, or glue, the liquid may be spilled in the groove and prevent proper resealing. Indeed, when using a brush to remove these types of liquids, it is quite common to dip the brush into the vessel through a mouth adjacent the sealing groove and then to wipe the liquid-laden brush along the edge of the container to control the amount of liquid retained by the brush. This practice often results in the inadvertent accumulation of the liquid in the sealing groove.

One solution to this problem is to remove materials which have accumulated in the groove before attempting to reseal the container. Unfortunately, this clean up procedure can be difficult and time consuming—especially when an adhesive liquid is involved. Another possible solution to this problem is to add a special groove covering device such as the one disclosed in U.S. Pat. No. 3,913,785 to Pattershall. This device may also facilitate secure stacking of multiple containers. However, this extra device generally complicates container usage.

Other stackable containers suitable for liquid storage are disclosed in U.S. Pat. Nos. 5,150,804 to Blanchet et al.; 4,718,571 to Bordner; and 3,880,288 to Hunter. The vessel sidewall for one of these containers is tapered in an apparent effort to facilitate stacking. Also, at least a portion of the lid for these containers extends past the outermost perimeter of the vessel sidewall. Unfortunately, tapered sidewalls and protruding lids often lead to the formation of gaps between such vessels when stored side by side. These gaps may result in less efficient use of available storage space than might otherwise be possible. Thus, a need remains for a container that does not rely on a groove in the top side of a vessel for sealing a press-on lid. Furthermore, more efficient storage and secure stacking of multiple containers should be accommodated. The present invention satisfies this need.

SUMMARY OF THE INVENTION

One feature of the present invention is a container for storing liquid which comprises a rigid vessel defining a chamber to retain liquid. The vessel has a generally vertical sidewall and an outer top surface. The outer top surface defines a mouth intersecting the chamber which is configured to move liquid to and from the chamber. The outer top surface also defines a circumferential ledge having an outer edge connected to the sidewall and an upturned lip connected to the ledge and circumscribing the mouth. The lip is horizontally inset from the outer edge by the ledge.

A lid is removably connected to the vessel by press-on attachment with the lid having an upper surface opposing a lower surface. The lid includes a circumferential outer flange seated on the ledge and has a stacking rib projecting upward from the upper surface. The rib is circumscribed by the flange. The rib circumscribes a central portion of the lid which extends along a plane generally perpendicular to the sidewall. A sealing channel is defined by the lower surface and positioned within the rib. The lip interlockingly engages the channel to seal the lid over the mouth. The outer top surface is grooveless and is configured without a cavity, depression, or recess capable of accumulating liquid. This configuration of the top surface provides a container seal area which is easy to clean, even if the container is used for paint, varnish, glue, or another adhesive type liquid.

In another feature of the present invention, a first container defines a first chamber for storing liquid. The first container has a bottom surface with a first outer edge. The bottom surface defines a stacking recess horizontally inset from the outer edge. Also, a second container defines a second chamber for storing liquid. The second container has an outer top surface with a second outer edge. The top surface defines a mouth to move liquid to and from the second chamber with an upturned lip circumscribing the mouth. The lip is inset from the second outer edge by a circumferential ledge integrally connected to the lip. The second container has a lid with an upright stacking rib circumscribing a central portion which is configured to engage the stacking recess. A sealing channel is defined within the rib to interlockingly engage the lip and seal the lid over the mouth. A circumferential outer flange is seated on the ledge and integrally connected to the rib. The outer top surface is grooveless and the rib engages the recess to securely stack the first container on the second container to form a container column along a generally vertical axis. The column has a generally uniform cross-section along the vertical axis. Multiple container columns may be stacked side by side to make efficient use of storage space.

Accordingly, one object of the present invention is to provide a container having a press-on lid with a seal which is easy to clean.

Another object is to provide a stackable container with an easy clean seal which has a generally constant cross-section to improve storage efficiency of multiple containers.

Further objects, features, and advantages of the present invention shall become apparent from the detailed drawings and descriptions provided herein.

DESCRIPTION OF THE PREFERRED EMBODIMENT

Figure 1:
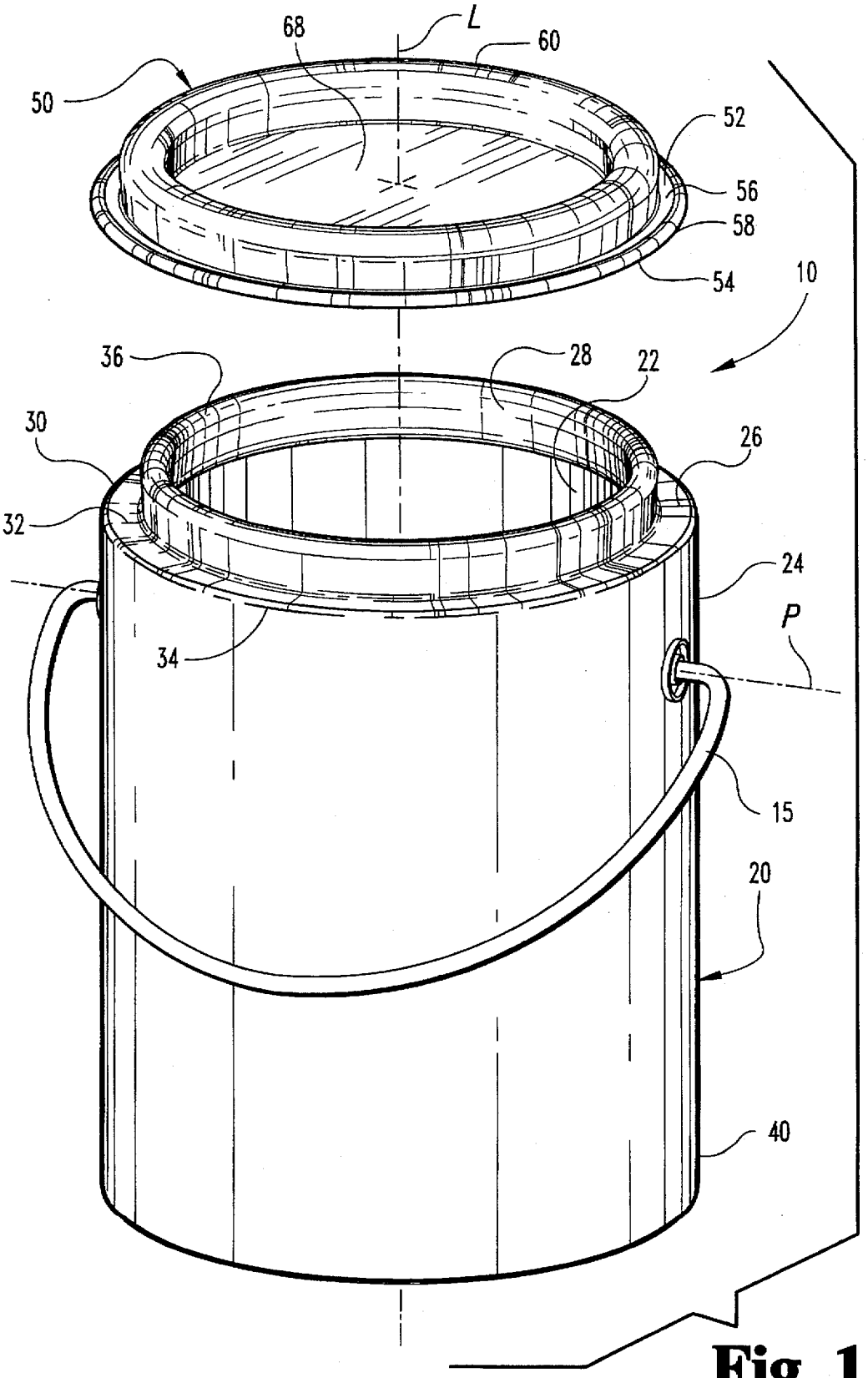
FIG. 1 is an exploded perspective view of a container of one preferred embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended. Any alterations, further modifications in the illustrated device, or further applications of the principles of the invention as illustrated herein, are also contemplated as would normally occur to one skilled in the art to which the invention relates.

FIG. 1 shows a container 10 of the present invention along a longitudinal axis L. Axis L is generally vertical when container 10 is resting on a horizontal surface. Container 10 has a handle 15 mounted thereto which is configured to pivot about an axis P generally perpendicular to axis L. However, handle 15 may be absent in other embodiments. Container 10 also has a vessel 20 and a lid 50. Vessel 20 has a base 40 adapted to provide stable positioning of container 10 on a generally horizontal surface. Typically, this orientation is preferred for using and storing container 10.

Vessel 10 defines a chamber 22 configured to retain a liquid or other material therein. Vessel 20 has an outer sidewall 24 surrounding chamber 22. Sidewall 24 has a generally vertical and continuously curved surface corresponding to the generally right circular cylindrical shape of vessel 20. Vessel 20 also has an outer top surface 26 defining mouth 28. Mouth 28 intersects chamber 22 and provides a way to pass material into and out of vessel 20. Preferably, mouth 28 is sized for the convenient removal of a liquid contained in chamber 22 by a brush or similar instrument. In other embodiments, mouth 28 may be otherwise sized to accommodate a different type of material.

Vessel 20 also has a shoulder 30. Shoulder 30 includes a generally flat circumferential ledge 32 with an outer edge 34 where outer top surface 26 meets sidewall 24. Ledge 32 horizontally offsets upturned lip 36 from outer edge 34. Lip 36 surrounds or circumscribes mouth 28. Notably, upper top surface 26 is grooveless and contains no recesses, depressions or cavities which might retain a liquid or other material that is inadvertently spilled onto outer top surface 26. In an alternative embodiment, at least a portion of ledge 32 is configured to slope downward from lip 36 toward outer edge 34. In this configuration, outer top surface 26 still lacks any grooves, depressions, recesses, or cavities likely to entrap material or encourage the accumulation of a liquid.

Figure 2:
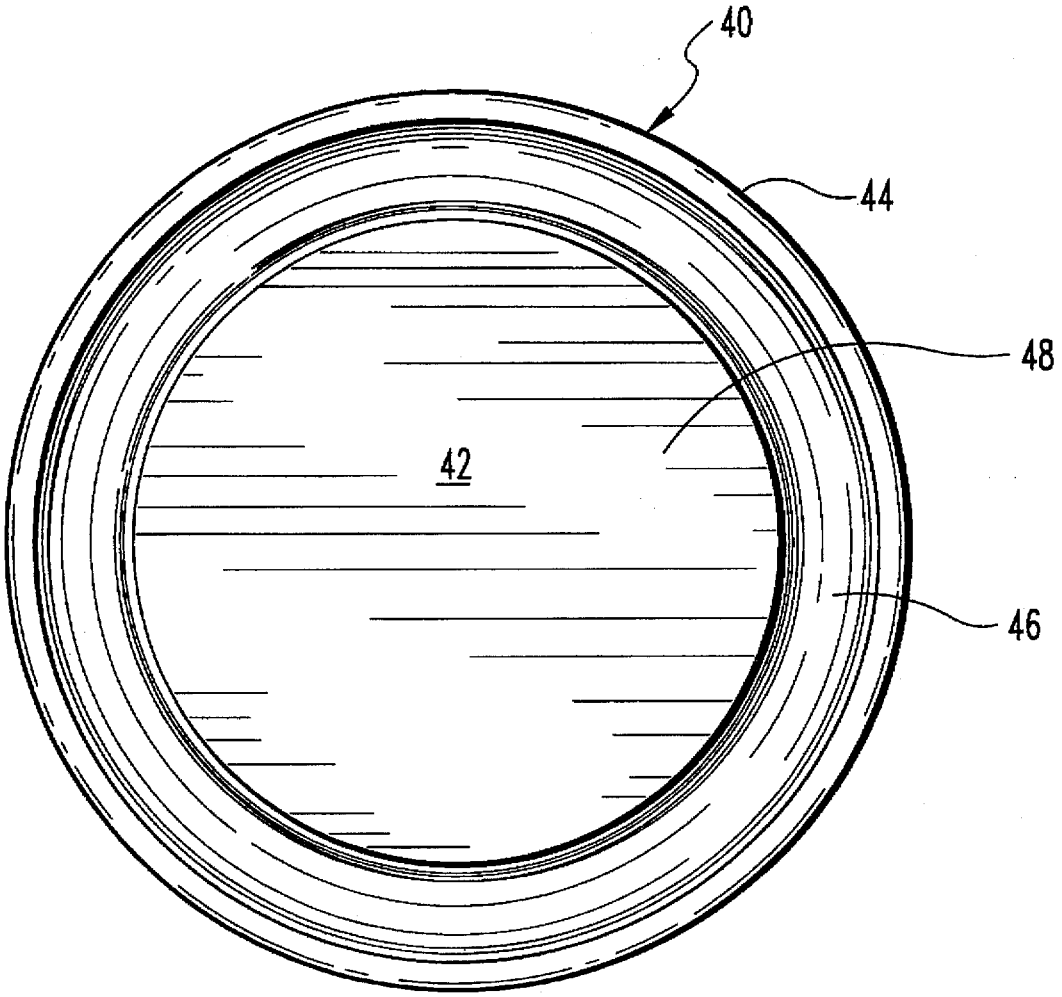
FIG. 2 is a bottom plan view of the embodiment shown in FIG. 1.
Figure 3:
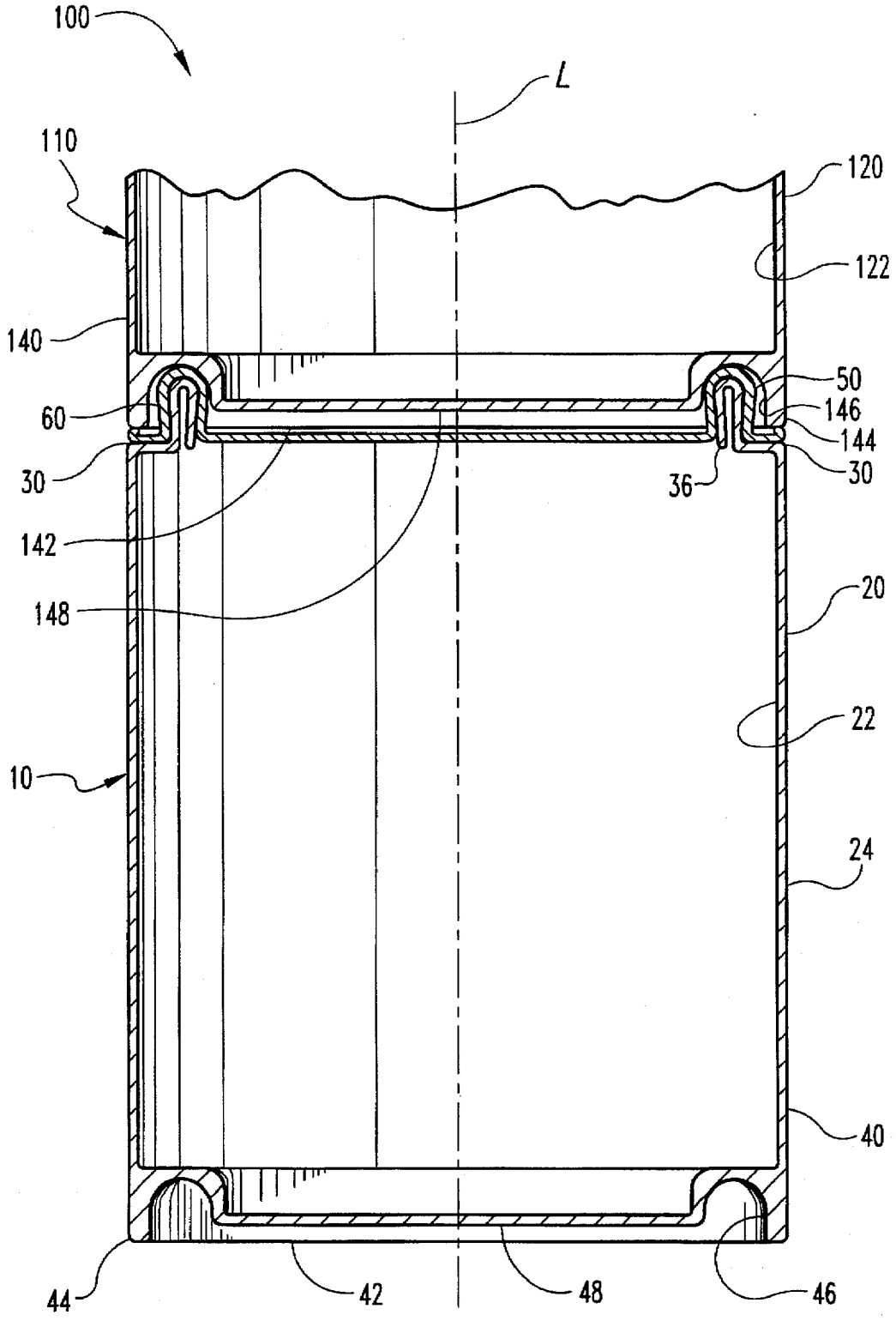
FIG. 3 is a partial cross-sectional view of another preferred embodiment of the present invention utilizing the container shown in FIGS. 1 and 2.

Lid 50 has upper surface 52 opposing lower surface 54. Upper surface 52 and lower surface 54 correspond to upper and lower sides of lid 50. Lid 50 also has a circumferential flange 56 with an outer edge 58. Flange 56 circumscribes stacking rib 60. Stacking rib 60 surrounds generally flat central portion 68. Central portion 68 generally extends along a plane approximately perpendicular to sidewall 24. Lid 50 is configured for press-on engagement with lip 36 to seal vessel 20. Referring additionally to FIGS. 2 and 3, base 40 of vessel 20 is shown in more detail. Base 40 has bottom surface 42 joining sidewall 24 at outer edge 42. Bottom surface 42 defines a stacking recess 46 surrounding central portion 48. Stacking recess 46 is configured to receive stacking rib 60 to facilitate secure stacking of multiple containers 10. Stacking recess 46 is depicted as an annular groove, but may be a right cylindrical space or otherwise configured as would occur to one skilled in the art.

Preferably, vessel 20 and lid 50 are made from a metal. In one embodiment, lid 10 is formed from a unitary sheet of metal. However, either vessel 20 or lid 50 may be configured from a thermoplastic compound or such other material as would occur to one skilled in the art.

In the embodiment of FIGS. 1–3, shoulder 30, ledge 32, lip 36, flange 56, rib 60, and recess 46 are generally shaped as continuous annular rings. Similarly, mouth 28, central portion 48, and central portion 68 are generally circular. These annular and circular shapes correspond to the general shape of vessel 20 as a right circular cylinder. In other embodiments, shoulder 30, ledge 32, lip 36, flange 56, rib 60, recess 46, mouth 28, central portion 48, and central portion 68 may not be continuous and may be shaped differently as may occur to one skilled in the art.

For example, these structures may be shaped to accommodate different shapes of vessel 20. In one alternative embodiment, vessel 20 has a rectangular box or cube shape with four sidewalls joined at generally right angles. In still another embodiment, vessel 20 may have a generally regular hexagonal cross-section with six angularly joined sidewalls to provide close side by side placement in a "honeycomb" configuration. Notably, these alternatively shaped vessels provide for close side-by-side arrangement of multiple containers. This arrangement is particularly advantageous when storage space is at a premium. In other embodiments, vessel 20 has more or less walls corresponding to a selected shape.

Figure 4:
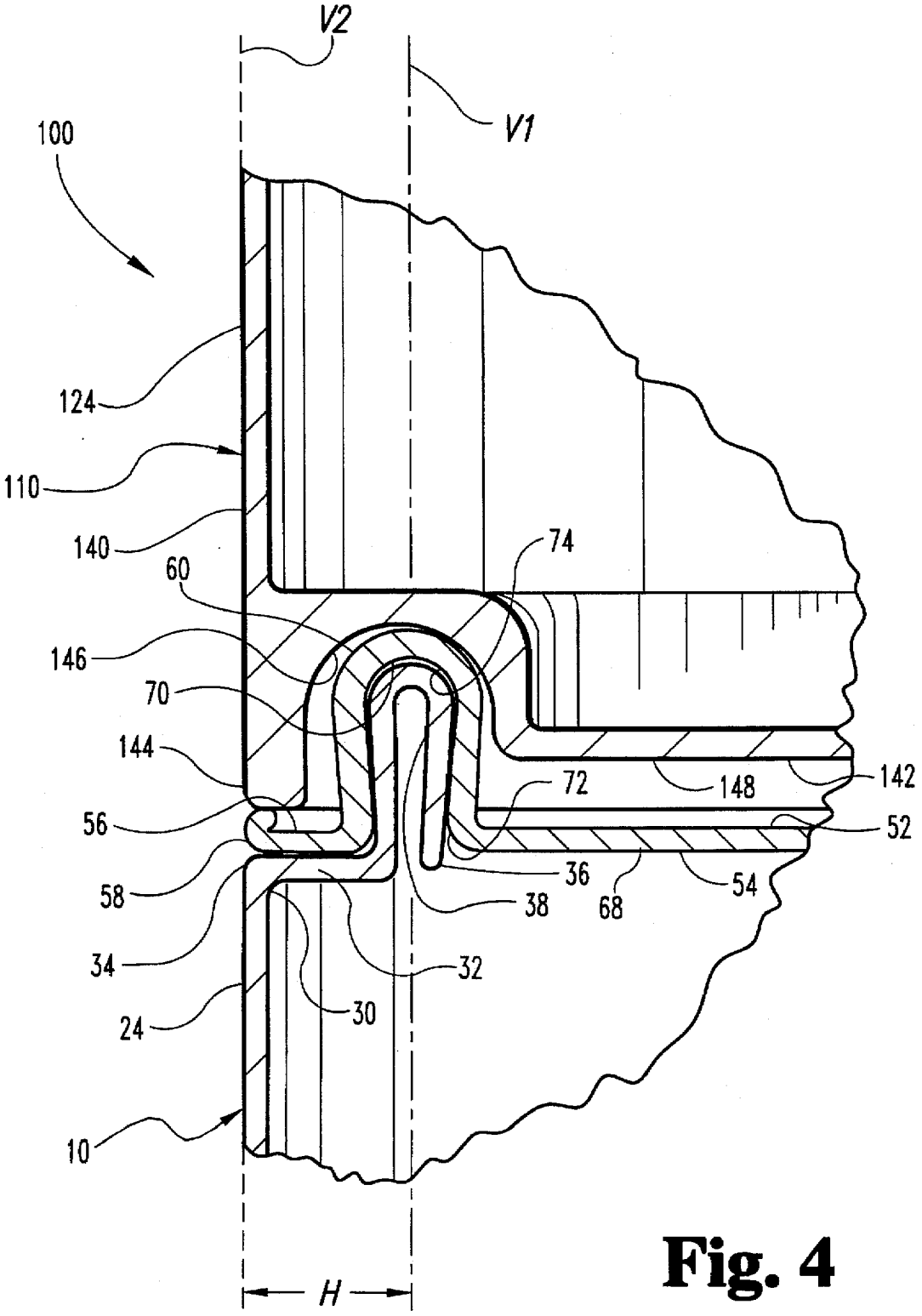
FIG. 4 is a fragmentary cross-sectional view of a portion of the embodiment shown in FIG. 3.

Referring to FIGS. 3 and 4, lid 50 is shown pressed on to vessel 20 to seal chamber 22 by interlocking engagement of lip 36. When vessel 20 is sealed, flange 56 is configured to rest on ledge 32. For other configurations or shapes of ledge 32, flange 56 may be correspondingly configured to rest thereon.

Lower surface 54 of lid 50 defines sealing channel 70 within rib 60. Sealing channel 70 is open to the lower side of lid 50. The cross-section of sealing channel 70 shown in the view plane of FIG. 4 reveals a neck portion 72 which is generally narrower than bulge portion 74. The cross-sectional shape of sealing channel 70 cooperates with lip 36 to provide secure sealing of chamber 22. Both lip 36 of vessel 20 and outer edge 58 of lid 50 have a rolled outer edge bead structure. The rolled outer edge of lip 36 defines space 38. In other embodiments, lip 36 and edge 58 may not include a rolled outer edge bead configuration.

Preferably, lip 36 is made from a resilient material so that it elastically deforms to snugly fit through neck portion 72. Once lip 36 passes through neck portion 72, it is preferred that restoring forces at least partially return lip 36 to its undeformed shape within the relatively larger bulge portion 74 to securely seal container 10. For embodiments of lip 36 which include a rolled edge, elastic deformation of lip 36 is facilitated by creation of a hinge point corresponding to the roll or bend in the lip edge. Also, embodiments providing space 38 facilitate elastic deformation of lip 36 by offering more space within which the deformation can occur.

The interlocking engagement of channel 70 by lip 36 may also be promoted by configuring lid 50 to elastically deform so that neck portion 72 widens slightly to permit lip 36 to pass therethrough and then rebounds once lip 36 is received in bulge portion 74. In other embodiments, only lid 50 or lip 36 is configured to elastically deform. In still other embodiments, elastic deformation of lid 50 or vessel 20 is not necessary to provide a secure seal. Preferably, removal of lid 50 connected to vessel 50 by press-on attachment is accomplished by prying lid 50 off with a tool between flange 56 and ledge 32. However, in other embodiments, a handle, pull tab, or other means may be employed as would occur to one skilled in the art.

FIGS. 3 and 4 present a partial cross-sectional view of a stacked container column 100. Column 100 includes container 10 depicted in FIGS. 1 and 2 with container 110 stacked thereon. Container 110 includes vessel 120 defining chamber 122. Chamber 122 is surrounded by generally vertical sidewall 124.

The fragmentary view of container 110 shows base 140 with a bottom surface 142. Bottom surface 142 has outer edge 144 and defines annular stacking groove 146. Groove 146 receives rib 60 of lid 50 therein and encircles central portion 148. Notably, groove 146 is configured with a volume slightly larger than necessary to receive rib 60 to provide for dimensional variances of one container to another.

Preferably, container 110 is configured generally the same as container 10 having a common shape and volume. This similar configuration facilitates interchangeable stacking of containers 10 and 110 with ease. Furthermore, it should be noted that additional containers may be utilized to provide a taller column of stacked containers. Nonetheless, in other embodiments, container 110 may be shaped differently than container 10 without departing from the spirit of the invention.

Next, various other features of container column 100 are described. Lip 36 is horizontally inset about distance H from outer edge 34 of shoulder 30. Similarly, rib 60 is inset about distance H from outer edge 58 of lid 50. Also, groove 146 is horizontally inset about distance H from outer edge 144. Consequently, lip 36, rib 60, and groove 146 are configured to align generally along a vertical axis V1 for column 100. Likewise, outer edges 34, 44, 58, 144, and generally vertical outer sidewalls 24, 124 are aligned along axis V2 with V2 being spaced about distance H from axis V1. These alignments facilitate interchangeable and compact stacking and storing of containers 10, 110.

Notably, annular groove 146 occupies relatively little volume of container 110 compared to a configuration having a right circular recess in the bottom surface to accommodate stacking. Also, by aligning lip 36 within channel 70 of rib 60, a relatively small amount of structure is dedicated to providing secured stacking on the top portion of container 10. Container 110 may be similarly configured with this top closure and stacking structure. In other embodiments, the stacking structure may be variously configured and off-set from one another as would occur to one skilled in the art.

Also, it should be noted that column 100 has a generally right circular cylinder shape with a substantially circular cross-section taken along axis L. This circular cross-section has a generally uniform outer perimeter and shape. Preferably, column 100 and containers 10, 110 have no portion which is tapered with respect to axis L. This arrangement provides for compact side by side placement of multiple columns 100. Preferably, outer edges 34, 44, 58, and 144 do not horizontally extend past the outermost perimeter of column 100 established by sidewalls 24, 124 so that space wasting gaps may be minimized when storing several columns side by side. In other embodiments, the container column of the present invention has a uniform cross-section along axis L with a regular hexagonal or square shape which also facilitates compact storage of multiple stacked container columns. In still other embodiments, various edges may protrude horizontally beyond the container sidewall and the column shape may be varied as would occur to one skilled in the act.

All publications and patent applications cited in this specification are herein incorporated by reference as if each individual publication or patent application were specifically and individually indicated to be incorporated by reference.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A container for storing liquid, comprising:

a rigid vessel defining a chamber to retain liquid, said vessel having a generally vertical sidewall and an outer top surface, said outer top surface defining:

a mouth intersecting said chamber, said mouth being configured to move liquid to and from said chamber, a circumferential ledge having an outer edge, said sidewall being connected to said ledge at said outer edge, an upturned lip connected to said ledge and circumscribing said mouth, said lip being horizontally inset from said outer edge by said ledge;

a lid removably connected to said vessel by press-on attachment, said lid having:

an upper surface opposing a lower surface, a circumferential outer flange seated on said ledge, a stacking rib projecting upward from said upper surface, said rib being circumscribed by said flange, said rib circumscribing a central portion of said lid, said central portion extending along a plane generally perpendicular to said sidewall, a sealing channel defined by said lower surface and positioned within said rib, said lip interlockingly engaging said channel to seal said lid over said mouth; and, wherein said outer top surface is grooveless and is configured without a cavity capable of accumulating liquid, said lip has a resilient rolled edge bead configured to elastically deform during press-on attachment to promote sealed engagement of said lid to said vessel, said flange has a generally flat flange surface, said ledge has a generally flat ledge surface, and said flange surface and said ledge surface meet in face to face contact when said flange is seated on said ledge.

2. The container of claim 1, wherein said ledge is approximately perpendicular to said lip.

3. The container of claim 2, wherein said rib is approximately perpendicular to said flange, and said central portion is generally flat and integrally connected to said rib.

4. The container of claim 3, wherein:

said vessel is generally cylindrically shaped;

said ledge, said lip, said flange, said rib, and said channel are generally annular; and said central portion is generally circular.

5. The container of claim 1, wherein said vessel has a bottom surface opposing said top surface, and said bottom surface defines a stacking recess configured to receive said stacking rib therein to provide for stable stacking of a plurality of the containers.

6. The container of claim 1, wherein said sidewall terminates at said outer edge.

7. The container of claim 1, wherein said outer edge does not extend outwardly beyond said sidewall.

8. The container of claim 1, wherein said sidewall does not extend above said ledge.

9. The container of claim 8, wherein said sidewall terminates at said outer edge and said outer edge does not extend outwardly beyond said sidewall.

10. A liquid storage system, comprising:

a first container defining a first chamber for storing liquid, said first container having a bottom surface terminating at a first generally vertical sidewall to define a first outer edge, said bottom surface defining a stacking recess horizontally inset from said first outer edge;

a second container defining a second chamber for storing liquid, said second container having:

a second generally vertical sidewall aligned with said first sidewall, an outer top surface terminating at said second sidewall to define a second outer edge, said top surface defining a mouth to move liquid to and from said second chamber, an upturned lip circumscribing said mouth and inset from said second outer edge by a circumferential ledge integrally connected to said lip, a lid having an upright stacking rib circumscribing a central portion and configured to engage said stacking recess, a sealing channel defined within said rib to interlockingly engage said lip and seal said lid over said mouth, and a circumferential outer flange seated on said ledge and integrally connected to said rib; and, wherein said outer top surface is grooveless, said rib engages said recess to securely stack said first container on said second container to form a container column along a generally vertical axis, said column has a generally uniform cross-section along said vertical axis, and said cross-section has a generally uniform outer perimeter and shape.

11. The system of claim 10, wherein said first and second containers generally have a common shape and size.

12. The system of claim 11, wherein said column is generally cylindrical and said cross section is generally circular.

13. The system of claim 12, wherein:

said stacking recess is an annular groove;

said ledge, said lip, said flange, said rib, and said channel are generally annular; and said central portion is generally circular.

14. The system of claim 10, wherein said lip has a resilient rolled edge bead configured to elastically deform during press-on attachment to promote sealed engagement of said lid to said vessel.

15. The container of claim 10, wherein said rib is configured to elastically deform during interlocking engagement of said lip in said channel to seal said lid on said vessel.

16. The container of claim 10, wherein said ledge is generally flat and approximately perpendicular to said lip, said flange is generally flat, said rib is approximately perpendicular to said flange, and said central portion is generally planar and integrally connected to said rib.

* * * * *